US007571837B2

(12) United States Patent
Orlowski

(10) Patent No.: US 7,571,837 B2
(45) Date of Patent: Aug. 11, 2009

(54) SQUIRTING TOY

(75) Inventor: Boguslaw Orlowski, Oceanside, CA (US)

(73) Assignee: Prime Time Toys, Ltd., Kwun Tong (HK)

( * ) Notice: Subject to any disclaimer, the term of this patent is extended or adjusted under 35 U.S.C. 154(b) by 0 days.

(21) Appl. No.: 11/860,617

(22) Filed: Sep. 25, 2007

(65) Prior Publication Data

US 2008/0035680 A1 Feb. 14, 2008

Related U.S. Application Data

(63) Continuation of application No. 10/942,326, filed on Sep. 16, 2004, now Pat. No. 7,281,642.

(51) Int. Cl.
*B67D 5/42* (2006.01)

(52) U.S. Cl. ..... 222/386; 222/79; 448/153

(58) Field of Classification Search ..... 222/386, 222/212, 79, 409, 518, 511, 513; 446/153, 446/473; 92/246; 482/55
See application file for complete search history.

(56) References Cited

U.S. PATENT DOCUMENTS

| | | | | | |
|---|---|---|---|---|---|
| 0,213,050 | A | | 3/1879 | Lewis | |
| D26,839 | S | | 3/1897 | Lines | |
| 1,031,526 | A | | 7/1912 | Cloud | |
| 1,394,456 | A | * | 10/1921 | Wanat | 446/192 |
| D060,050 | S | | 12/1921 | Mohler | |
| 2,573,375 | A | | 10/1951 | Winstead | |
| D225,755 | S | | 1/1973 | Hale | |
| D240,130 | S | | 6/1976 | Folke | |
| 4,193,517 | A | | 3/1980 | Fetty et al. | |
| 4,383,387 | A | | 5/1983 | Puskar | |
| 4,548,190 | A | * | 10/1985 | Megargee | 124/56 |
| 4,597,527 | A | | 7/1986 | Sands | |
| 4,615,488 | A | | 10/1986 | Sands | |
| 4,627,796 | A | | 12/1986 | Moore | |
| 4,673,007 | A | | 6/1987 | Huang | |
| 4,733,799 | A | | 3/1988 | Wiskur | |
| 4,796,785 | A | * | 1/1989 | Merritt | 222/131 |
| 4,809,483 | A | | 3/1989 | Lovik | |
| 4,919,600 | A | | 4/1990 | Yang | |
| 5,009,413 | A | | 4/1991 | Allen | |
| 5,120,261 | A | * | 6/1992 | Dietzman | 446/473 |

(Continued)

FOREIGN PATENT DOCUMENTS

| | | |
|---|---|---|
| GB | 2045097 | 10/1980 |

OTHER PUBLICATIONS

U.S. Appl. No. 29/302,703.

(Continued)

*Primary Examiner*—Lien T Ngo
(74) *Attorney, Agent, or Firm*—Amster, Rothstein & Ebenstein LLP

(57) ABSTRACT

A squirting toy is comprised of a cylindrical housing and a piston that slides within to force water into or out of the housing via a hole therein. The housing is encased within a polyethylene closed cell foam shell. The shell is non-absorbing, so that the foam remains buoyant and keeps the gun afloat indefinitely when left in water. The foam is soft, so that the gun is not a safety hazard when left floating in a swimming pool.

17 Claims, 4 Drawing Sheets

U.S. PATENT DOCUMENTS

| | | | | | |
|---|---|---|---|---|---|
| 5,181,644 | A | | 1/1993 | Ferrell | |
| 5,199,114 | A | | 4/1993 | Christopher | |
| D336,668 | S | * | 6/1993 | D'Andrade | D21/572 |
| D337,354 | S | | 7/1993 | Childs | |
| 5,224,633 | A | | 7/1993 | Senart | |
| D338,697 | S | | 8/1993 | Salmon et al. | |
| 5,231,951 | A | | 8/1993 | Tagar et al. | |
| D339,616 | S | | 9/1993 | Flaherty | |
| 5,255,708 | A | | 10/1993 | Liparoto et al. | |
| 5,256,099 | A | * | 10/1993 | Rudell et al. | 446/473 |
| 5,266,069 | A | * | 11/1993 | Thorne | 482/111 |
| D344,311 | S | | 2/1994 | Liu | |
| D344,556 | S | | 2/1994 | Liu | |
| D351,007 | S | | 9/1994 | Bednar et al. | |
| D352,093 | S | | 11/1994 | Knycha | |
| D354,093 | S | | 1/1995 | Hamlin | |
| D358,185 | S | | 5/1995 | Hope, II | |
| 5,499,858 | A | | 3/1996 | Her | |
| 5,683,250 | A | | 11/1997 | Paivanas | |
| 5,788,617 | A | * | 8/1998 | Paris | 482/112 |
| 5,928,053 | A | | 7/1999 | Henderson | |
| 5,988,442 | A | | 11/1999 | Corey et al. | |
| 5,992,697 | A | | 11/1999 | James | |
| 6,027,393 | A | * | 2/2000 | O'Rourke | 446/153 |
| D481,770 | S | | 11/2003 | Choy | |
| 6,722,679 | B2 | | 4/2004 | Englert | |
| 6,790,112 | B2 | | 9/2004 | Kirk | |
| 6,843,695 | B1 | | 1/2005 | Jackson et al. | |
| D514,633 | S | | 2/2006 | Zheng | |
| 7,025,228 | B2 | | 4/2006 | Cuisinier | |
| D524,881 | S | | 7/2006 | Orlowski | |
| D528,914 | S | | 9/2006 | Williams | |
| D536,040 | S | | 1/2007 | Orr et al. | |
| D557,356 | S | | 12/2007 | Johnston | |
| D557,357 | S | | 12/2007 | Johnston | |
| D558,278 | S | | 12/2007 | Johnston | |
| D558,279 | S | | 12/2007 | Chen | |
| D574,443 | S | | 8/2008 | Wong | |
| 2003/0124922 | A1 | | 7/2003 | Sowry | |
| 2003/0156950 | A1 | | 8/2003 | Ostrowiecki | |
| 2005/0106963 | A1 | | 5/2005 | Ross | |
| 2005/0184098 | A1 | | 8/2005 | Dixon | |
| 2005/0196287 | A1 | * | 9/2005 | Olich | 417/119 |
| 2006/0027596 | A1 | | 2/2006 | Walther et al. | |
| 2007/0000942 | A1 | | 1/2007 | Wong | |
| 2008/0054019 | A1 | | 3/2008 | Stechschulte et al. | |

OTHER PUBLICATIONS

U.S. Appl. No. 29/302,711.

* cited by examiner

SQUIRTING TOY

This application is a continuation of U.S. application Ser. No. 10/942,326, filed Sep. 16, 2004, now allowed, the contents of which are incorporated herein by reference in their entirety.

FIELD OF THE INVENTION

The present invention is a water squirting apparatus for use at play. More specifically, it is a soft floating tubular piston type squirt gun for use such as in a swimming pool or swimming area by participants in or adjacent to the water.

BACKGROUND AND OBJECTS OF THE INVENTION

Squirt guns are well known in many forms in the prior art. Numerous squirt guns and squirting toys are made and have been made over the years for use by persons while swimming in or standing adjacent to a swimming pool, which are adapted to quickly take in water from the swimming pool for squirting. One such toy is called Water Stix™ and is sold by Hearthsong Inc. This toy, representative of many such squirting toys, is basically comprised of a housing having a nozzle at its squirting end. A piston, which includes a graspable handle, is adapted to slide within the housing so that, when the nozzle end of the housing is submerged in the pool and the piston is pulled backwards, water is drawn into the housing through the nozzle. And when the piston is subsequently forced forwardly, that water is forced from the housing, through the nozzle, towards a target, in a powerful stream.

Additionally, many squirt guns of the prior art are constructed in a manner that entraps air and thereby inadvertently enables those guns to partially float in water. The degree of such buoyancy is relative to the amount of water that has been taken into the gun and the longevity of such buoyancy is relative to the to the amount of air leakage from the housing.

There are also floating toy "swimming noodles" in the prior art, which are made of resilient floating closed-cell polymer foam. These toys are used to provide buoyancy to the user while swimming. Because these toys are often left floating in the pool when not in use, their softness eliminates the safety threat that they would otherwise pose.

It is therefore an object of the present invention to provide an improved squirting toy that floats fully atop the surface of the water, whether filled with or empty of water.

It is a further object to provide a soft squirting toy that is safer that squirting toys of the prior art.

It is a further object to provide a squirting toy that is both buoyant and soft.

It is a further object to provide such a squirting toy that has a similar appearance to a "swimming noodle".

Further objects and advantages of the invention will be apparent upon a review of the following description and drawings of the invention, including the preferred embodiment thereof.

SUMMARY OF THE INVENTION

The present invention comprises a squirting toy that is housed within a polyethylene (PE) closed cell foam shell. The closed cell shell is non-absorbing, so that the foam remains buoyant and keeps the gun afloat indefinitely. The foam is soft, so that the gun is not a safety hazard when left floating in a swimming pool. In the preferred embodiment, the squirting toy is comprised of a cylindrical housing and a piston that slides within to force water into or out of the housing via a hole therein. The foam shell of the preferred embodiment is similar in size and shape to a "swimming noodle", and is therefore more attractive to a child who is familiar with such.

A more complete understanding of the invention will be realized upon review of the following description and drawings of the Preferred embodiment of the invention.

BRIEF DESCRIPTION OF THE DRAWINGS

FIG. 1 is an action view of a squirting toy according to the preferred embodiment of the invention showing water being expelled there-from.

DETAILED DESCRIPTION OF THE PREFERRED EMBODIMENT

Figure 1:
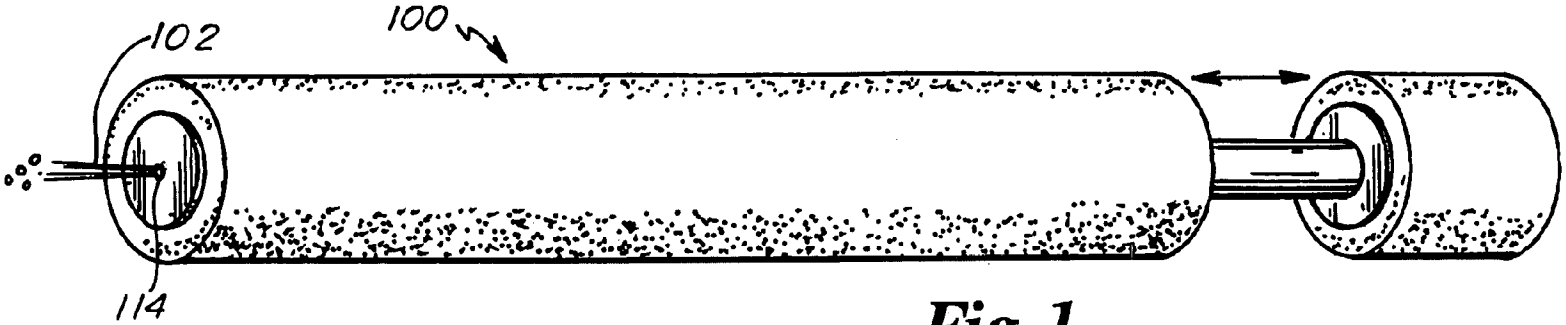

The Preferred embodiment of the invention is shown in FIGS. 1 though 5, where there is depicted a toy 100 for squirting a water stream 102, and which is adapted to float on the water surface 104.

Figure 4:
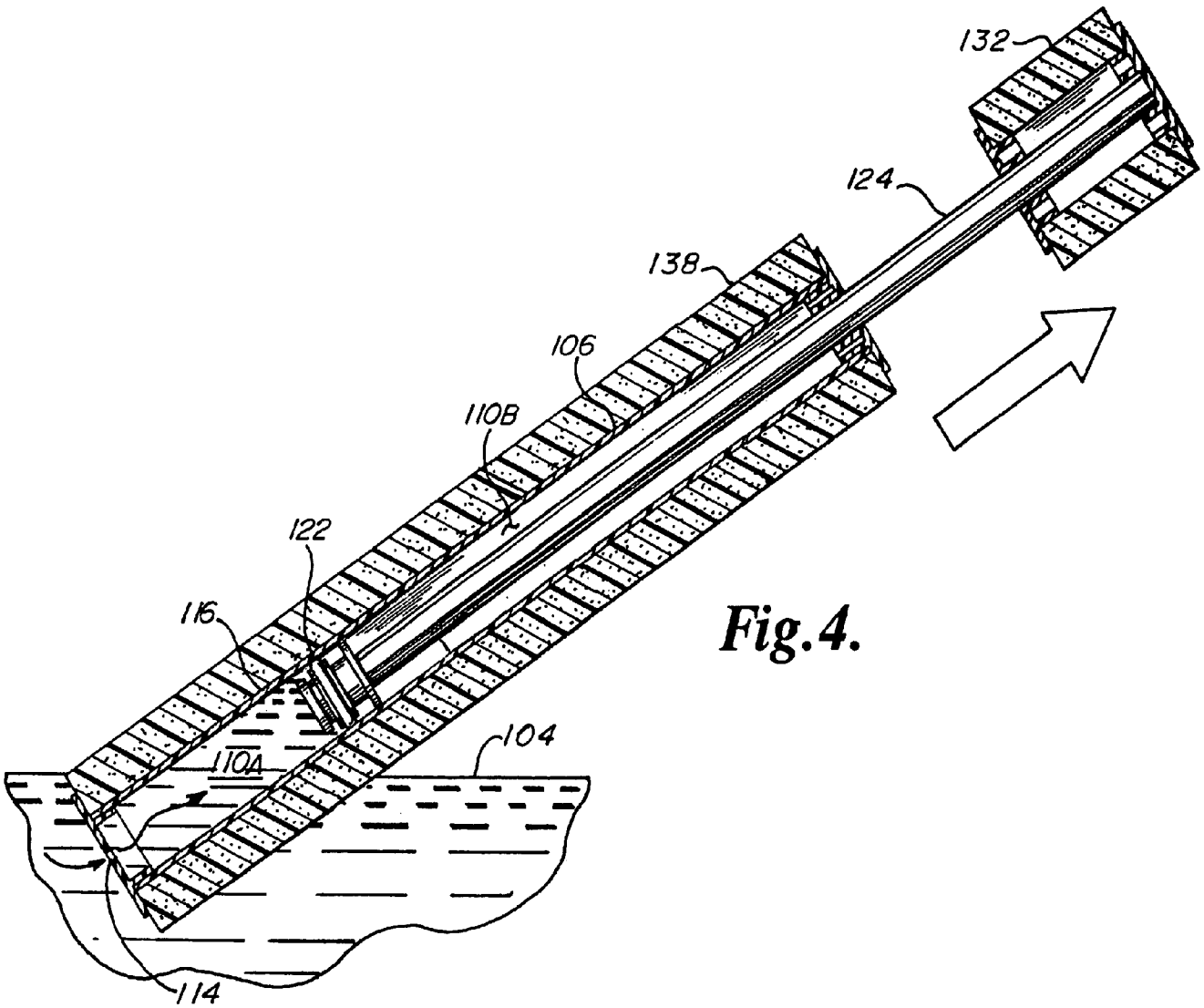
FIG. 4 is an action cross-sectional view in showing the intake of water into the toy of FIG. 1.
Figure 5:
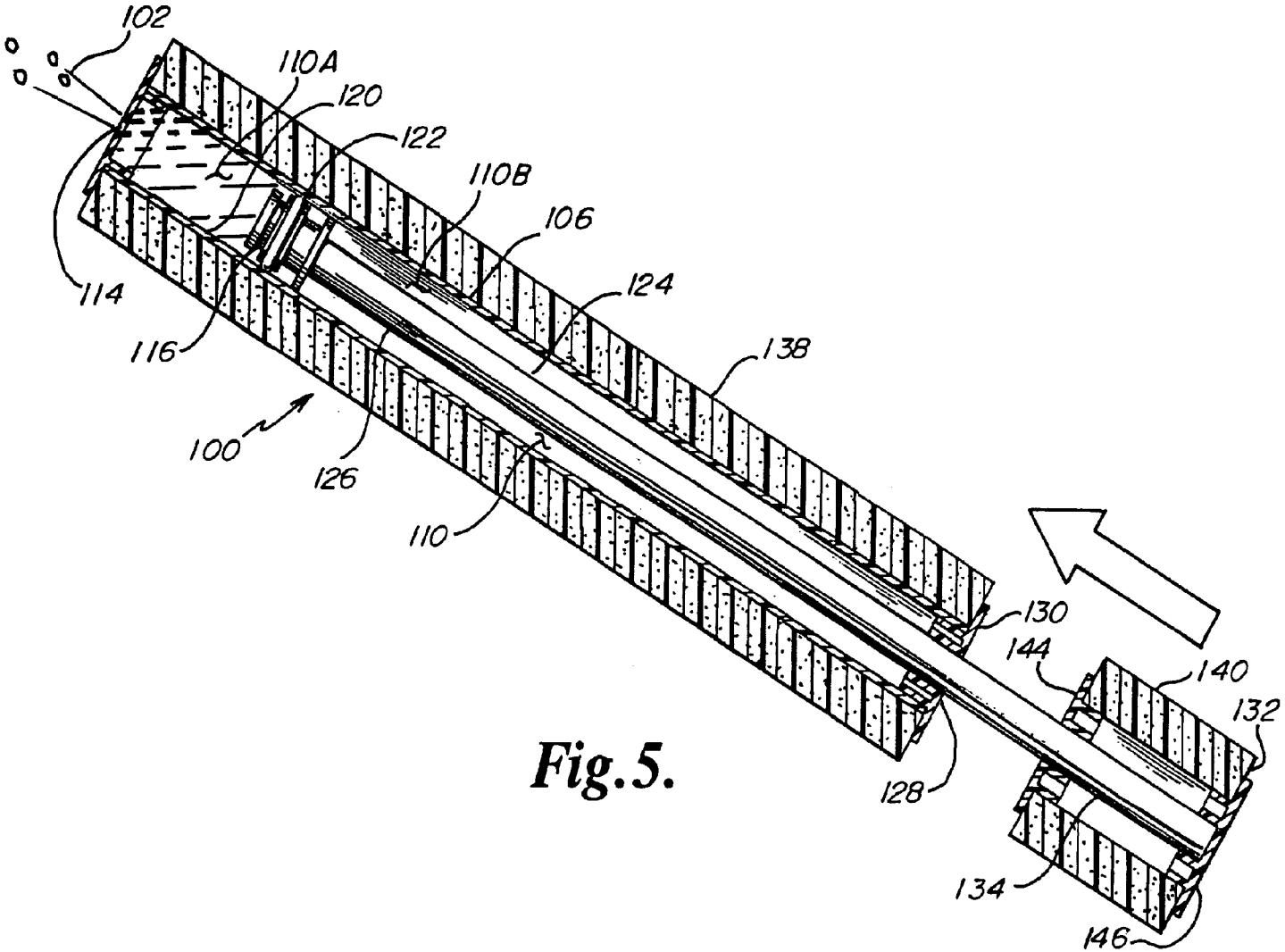
FIG. 5 is an action cross-sectional view in showing the expulsion of water from the toy of FIG. 1.

The toy comprises a rigid tubular housing 106 that encloses a hollow cylindrical chamber 110. The forward end 112 of the tubular housing is closed except for a small hole 114. Piston 116 slides longitudinally within chamber 110 and is sealed against the cylindrical inner surface 120 of the chamber by o-ring 122, which is seated within groove 124 of the piston. The piston separates the chamber 110 into a forward portion 110A and a rear portion 110B. The piston 116 is rigidly connected to shaft 124 at the forward end 126 thereof. Slide bushing 128 supports shaft 124 at the rear end 130 of the tubular housing 106, while allowing longitudinal movement relative thereto. Handle portion 132 is rigidly connected to shaft 124 at the rearward end 134 thereof. Expansion of the handle portion 132 relative to the tubular housing 106, while hole 114 is below the water surface 104, as depicted in FIG. 4, causes water to be inhaled into the expanding forward chamber portion 110A, through hole 114. Subsequent retraction of the handle portion 132 relative to the tubular housing 106 causes that water to be exhaled through hole 114 in a powerful stream 102.

Tubular shell 138, preferably made of closed-cell polyethylene foam, surrounds tubular housing 106, to provide both a soft protective surface and buoyancy. Other materials may be substituted for polyethylene foam, such as ethylene vinyl acetate closed-cell foam.

Figure 2:
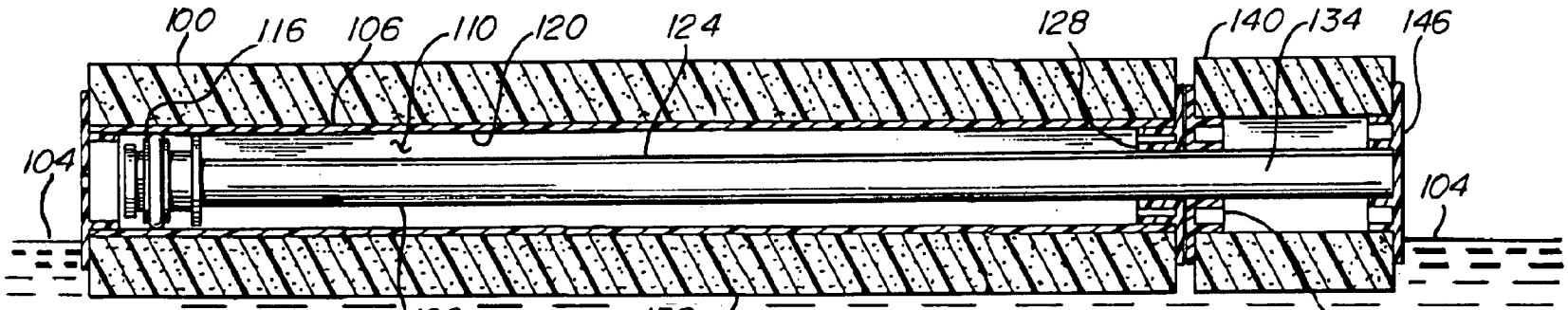
FIG. 2 is a cross-sectional view through the toy of FIG. 1 in its retracted/empty state.
Figure 3:
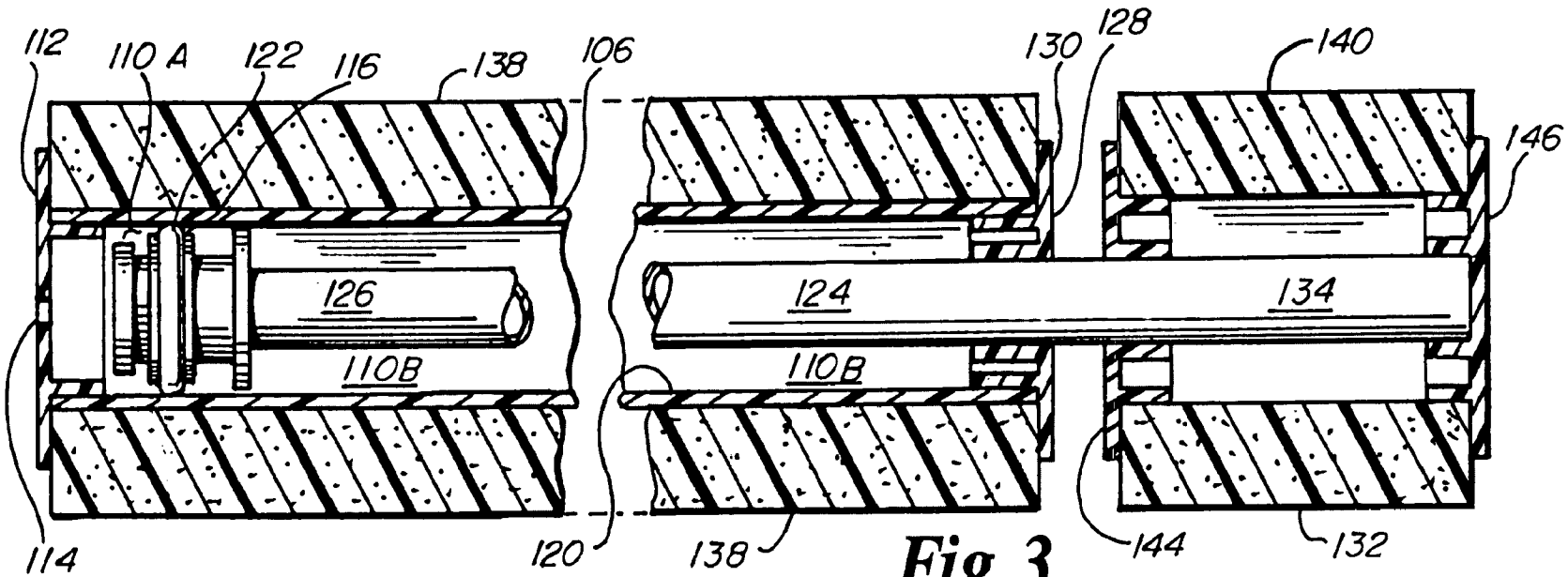
FIG. 3 is an enlarged partial section of the toy of FIG. 1 floating in water.

Handle portion 132 also includes handle shell 140, which is preferable made of the same foam, and is rigidly connected shaft 124 by means of support bushings 144 and 146. Alternatively, other materials having sufficient buoyancy, softness, and water impermeability, such as polyurethane foam, may be used for both the tubular and handle shells. Or the shells could instead be replaced by blow molded or rotationally molded air-filled cylindrical bladders. When the handle portion is retracts as in FIG. 2, the shells create a similar appearance and feel to those of a common "swimming noodle".

It will be appreciated by those skilled in the applicable arts that the foregoing is merely one of many possible embodiments of the invention, and that the invention should therefore only be limited according to the following claims.

I claim:

1. A squirting toy comprising:

a. a housing having a chamber comprising an interior wall, a first end, a second end and a hole in the first end;

b. a piston slidably engaged with the interior wall of the chamber and connected to a shaft, the shaft extending from the second end of the housing and comprising a handle external to the housing; and c. a soft non-water-absorbing shell disposed over a portion of the housing, the soft shell:

i. providing buoyancy to keep the toy afloat in water when the chamber is filled to its maximum capacity with water; and ii. forming a protective surface over the housing, wherein the shell extends between a forward end and a slide bushing, each of the forward end and the slide bushing having an outer dimension smaller than the outermost dimension of the shell, whereby the softness of the shell offers safety benefits.

2. The squirting toy of claim 1 wherein the soft shell is disposed over substantially the entirety of the housing.

3. The squirting toy of claim 1 further comprising a handle soft shell disposed over a portion of the handle.

4. The squirting toy of claim 1 wherein said chamber having a volume, said volume capable of expansion or contraction by movement of the piston, whereby said toy is adapted to inhale water into the volume through the hole during expansion of the volume while the hole is submerged and eject water through the hole during contraction of the volume.

5. The squirting toy of claim 1 wherein the safety benefits comprise at least one of softness and absence of hard edges.

6. A toy comprising:

a. means for receiving, storing and squirting water, including a rigid housing and a water receiving chamber in the housing; and b. a soft non-water-absorbing shell on the housing having a float volume providing a buoyancy to keep the toy afloat in water when the toy is filled to its maximum capacity with water and covering a sufficient portion of the toy such that the softness of the shell provides safety benefits, wherein the shell is located between a forward end and a slide bushing on the housing, each of the forward end and the slide bushing having an outermost dimension smaller than the outermost dimension of the shell.

7. The toy of claim 6 wherein the shell is a closed cell polymer foam.

8. The toy of claim 6 wherein the means for receiving, storing, and squirting water comprising:

a. a water chamber having a first end, a second end, a hole in the water chamber first end and an interior wall, b. a shaft having a first end and a second end;

c. a piston attached to the first end of the shaft;

d. the second end of the shaft comprising a handle; and e. the piston slideably, sealingly contacting the interior wall and the handle extending from the water chamber second end.

9. The toy of claim 8 wherein said chamber has a water volume, said water volume capable of expansion or contraction by movement of the piston, whereby said toy is adapted to inhale water through the hole during expansion of said water chamber while the hole is submerged and eject water through the hole during contraction of said water chamber.

10. A toy for receiving, storing, and squirting water comprising:

a. a housing defining a chamber for receiving and storing the water, said chamber having a volume and means for expansion or contraction of said volume and said housing having a hole to allow communication between said chamber and the outside environment, whereby said toy is adapted to inhale water through said hole during expansion of said chamber while said hole is submerged and eject water through said hole during contraction of said chamber; and b. further comprising a soft outer shell that is impermeable to water and has a buoyancy keeping the toy afloat in water when said expanded chamber is full of water, wherein the shell is retained on the housing by a forward end and a slide bushing, each smaller than the outermost dimension of the shell, whereby the softness of the shell offers safety benefits.

11. The toy of claim 10 wherein said soft shell is closed-cell polymer foam.

12. The toy of claim 10 wherein said chamber is cylindrically shaped and said means for expansion and contraction of the chamber comprising a piston sealingly engaging an interior cylindrical surface of the chamber, said piston adapted for longitudinal movement within and relative to said cylinder to alternately expand and contract the volume within the chamber.

13. The toy of claim 12 wherein said outer shell is cylindrically shaped.

14. The toy of claim 13 wherein said soft shell is closed-cell polymer foam.

15. A toy for receiving, storing, and squirting water, comprising:

a. a housing defining a chamber for receiving and storing water, said chamber having a volume;

b. a piston disposed in the chamber and attached to a shaft having a handle portion, the handle portion disposed external to the chamber, the piston sealingly and slidingly engages an internal wall of the chamber and is actuatable by the handle of the shaft for expansion or contraction of the volume of the chamber;

c. a hole in the chamber in communication with the volume and the outside of the chamber, whereby said toy is adapted to inhale water through said hole into the volume during expansion of the volume of the chamber while said hole is submerged in water and squirt water through said hole during contraction of the volume; and d. further comprising a soft water impermeable outer shell on at least a portion of said toy providing a buoyancy to keep the toy afloat in water when said expanded chamber is full of water, wherein the shell is retained on the housing by a forward end and a slide bushing, each smaller than the outermost dimension of the shell, whereby the softness of the shell offers safety benefits.

16. The toy of claim 15, wherein the shaft further comprising a shaft central lumen extending from a first end to a second end of the shaft.

17. The toy of claim 16, wherein the handle further comprising a handle central lumen.

* * * * *